United States Patent [19]

Livesey et al.

[11] Patent Number: 4,922,220

[45] Date of Patent: May 1, 1990

[54] ADJUSTABLE CIRCUIT BREAKER THERMAL TRIP UNIT

[75] Inventors: John K. Livesey, Carnegie; James N. Altenhof, Jr., West Bridgewater Boro., both of Pa.

[73] Assignee: Westinghouse Electric Corp., Pittsburgh, Pa.

[21] Appl. No.: 327,221

[22] Filed: Mar. 22, 1989

[51] Int. Cl.[5] ..... H01H 71/16

[52] U.S. Cl. ..... 337/82; 337/46; 335/45

[58] Field of Search ..... 335/42, 45, 8–10; 337/46, 82

[56] References Cited

U.S. PATENT DOCUMENTS 2,884,497 4/1959 Steven et al. ..... 335/45
3,758,887 9/1973 Ellsworth et al. ..... 335/8
3,815,064 6/1974 Maier et al. .
4,255,732 3/1981 Wafer et al. .
4,698,606 10/1987 Mrenna et al. ..... 337/82

*Primary Examiner*—H. Broome
*Attorney, Agent, or Firm*—M. J. Moran

[57] ABSTRACT

Apparatus for adjusting the calibration of a thermal trip unit which is to be used in conjunction with an electrical circuit breaker. A rotatable knob is provided which adjusts the trip unit to between one hundred percent of the rating of the circuit breaker and some value which is less than one hundred percent. An adjustable stop screw is provided to engage the rotatable knob when the knob is rotated to adjust the calibration of the trip unit to the desired value which is less than one hundred percent of the rating of the breaker. The adjustable stop screw thereby limits travel of the adjustable knob between only one hundred percent of the rating of the circuit breaker and the desired value which is less than one hundred percent.

18 Claims, 2 Drawing Sheets

ADJUSTABLE CIRCUIT BREAKER THERMAL TRIP UNIT

BACKGROUND OF THE INVENTION

1. Field of the Invention

This invention relates to adjustable thermal trip units for circuit breakers and, more specifically, to an adjustable thermal trip unit wherein the low amperage trip setting of the trip unit may be adjusted independently of the high amperage trip setting.

2. Description of the Prior Art

Electrical circuit breakers are well known and have been employed for many years to control the flow of electrical current in serially connected electrical circuits. Typically, two modes of operation are provided to control the flow of current in the electrical circuit; a manual mode and an automatic mode.

In the manual mode, a person moves an operating lever between an on position and an off position which closes and opens, respectively, separable contacts within the circuit breaker. This either allows or interrupts the flow of electrical current through the circuit breaker and, thus, through the serially connected electrical circuit.

In the automatic mode of operation, the operating lever is first placed in the on position, thereby allowing electrical current to flow through the circuit breaker. When a predetermined overcurrent condition occurs the circuit breaker automatically opens the separable contacts thereby interrupting the flow of current to the electrical circuit.

The circuit breaker includes an operating mechanism which is mechanically connected to both the operating lever and the separable contacts and which moves the separable contacts between their open and closed positions in response to movement of the operating lever or in response to an automatic signal to open the contacts of the circuit breaker under the prescribed overcurrent conditions. An automatic trip unit is mechanically connected to the operating mechanism and employed to provide such an automatic signal thereby interrupting the flow of electrical current through the circuit breaker and the serially connected electrical circuit, under such prescribed conditions. This is termed "tripping the circuit breaker."

Automatic trip units, generally, employ two different apparatuses to trip the circuit breaker during overcurrent conditions. One such apparatus employs an electromagnet, which is connected to the electrical current path through the circuit breaker. The electromagnet includes a fixed member and a moveable member which develop varying degrees of magnetic flux, therebetween, in relation to the magnitude of current flowing through the circuit breaker. The magnetic flux applies a force to the moveable member and rotates it to an extent determined by the magnitude of electrical current flowing through the electrical circuit. The moveable member is connected to the trip bar of the trip unit and the trip bar trips the circuit breaker when rotated past a prescribed point.

The circuit breaker is assigned a nominal value, termed "rating," which is the maximum continuous magnitude of current which may flow through the circuit breaker without tripping. The electromagnet is designed to immediately trip the circuit breaker when the current flow through the electrical circuit exceeds approximately 500 percent of the rating of the breaker.

A second device employed in the automatic trip unit, which responds to overcurrent conditions of less than 500 percent of the rating of the breaker, is a thermal tripping device. Thermal tripping devices, typically, employ a bimetal strip wherein two different, generally, flat pieces of metal are mechanically attached together and define, generally, a planar surface when the temperature of the strips is equal to the ambient temperature surrounding the circuit breaker. The distinct metals from which each strip is constructed have different thermal expansion coefficients so that they elongate to different lengths whenever their temperatures are elevated above ambient.

The bimetal strip is mechanically connected to a heater which is connected in series with the electrical circuit and which has known heat generating electrical resistance properties wherein the rate of heat generation can be correlated to specific magnitudes of electrical current flow therethrough. The heater conducts some of the generated heat to the bimetal strip, thereby equally elevating the temperature of both strips which comprise the bimetal strip. Such heating of the bimetal strip causes it to bend out of its planar configuration since the two separate strips, from which the bimetal strip is formed, elongate to a different length under such temperature elevation.

The bimetal strip is positioned in spaced-apart relationship with respect to the trip bar of the trip unit when no current is flowing through the circuit breaker. However, when electrical current is flowing through the circuit breaker, the bimetal strip bends toward the trip bar. When the electrical current flowing through the circuit breaker exceeds the predetermined limit for a predetermined period of time, the bimetal strip will bend to such an extent that it engages the trip bar thereby rotating it and tripping the circuit breaker.

Typically, a set screw is interposed between the bimetal strip and the trip bar to provide for calibration of the trip unit. The set screw projects from the surface of either the bimetal strip or the trip bar by a distance which may be adjusted by rotating the set screw. By adjusting the set screw in this manner, the distance that the bimetal strip must bend before it rotates the trip bar and trips the circuit breaker may be adjusted. Since the distance that the bimetal strip bends is a function of the magnitude of current flow through the circuit breaker, with more current flow causing more bending, the trip unit may be calibrated to trip the circuit breaker at a particular magnitude of current flow by adjusting the set screw.

Some trip bars include an inclined, or ramp surface, for contacting set screws which are projecting from the bimetal strip. The trip bar is positioned within the trip unit in a manner which allows it to slide along its longitudinal axis in response to the operation of an external control.

The ramp surface is positioned on the trip bar in such a manner that the distance between the set screw and the ramp surface varies as the trip bar is moved along its longitudinal axis. Therefore, the distance that the bimetal strip must bend before it contacts and rotates the trip bar can be adjusted by either sliding the trip bar along its longitudinal axis or by altering the distance that the set screw projects from the bimetal strip.

Providing an adjustable ramp surface on the trip bar is desirable since it is, frequently, advantageous to be able to quickly and easily change the rating of the breaker. With an adjustable ramp contact surface this may be achieved in the following manner.

The trip bar is, initially, slid along its longitudinal axis as far as possible to achieve maximum separation between the adjustment screw on the bimetal strip and the ramp. This is the high end of the trip bar travel. The adjustment screw projecting from the bimetal strip is then rotated until the distance between the adjustment screw and the ramp surface allows maximum rated current to flow through the breaker without tripping. If the trip bar is then slid toward the low end, which is in the opposite direction from the high end, the distance between the set screw and ramp surface will decrease. Therefore the bimetal strip will rotate the trip bar and trip the circuit breaker at less than the maximum rating of the breaker.

In certain applications it is desirable to provide a trip unit which may be adjusted from the maximum rating to a specific rating which is less than the maximum rating. For example, in certain applications it is desirable to adjust the rating of a circuit breaker between maximum rating and 80 percent maximum rating.

In such circumstances, the ramp must be carefully engineered, and the set screw must be carefully adjusted, so that the rating of the breaker is at its maximum value when the trip bar is positioned at the high end of travel and at a value equal to exactly 80 percent of the maximum rating when the trip bar is positioned at the low end of travel. This presents several problems. First, the trip bar, the ramp surface and the external adjustment control which moves the trip bar must be engineered and manufactured under tolerances which ensure that the rating of the trip unit will be reduced to exactly 80 percent of the maximum when the trip bar is moved to the low end.

Since most of the parts which control the adjustment of the trip unit are formed from plastic type materials, this requires very carefully designed molds to ensure proper operation. Further, if the trip unit is removed from the particular circuit breaker for which it has been designed and substituted in a different circuit breaker, it may be possible that the rating of the circuit breaker, when the trip bar is at the low end, will be at some value other than 80 percent after the set screw has been properly adjusted to the maximum rating when the trip bar is moved to the high end. The present invention overcomes all of these limitations.

SUMMARY OF THE INVENTION

The present invention provides an adjustable stop mechanism for a circuit breaker thermal trip unit which includes a thermal trip adjuster which is adapted to travel between a first location and a second location. The mechanism includes stop apparatus in removable contact with the thermal trip adjuster which is adapted to be adjusted to one of a plurality of positions for limiting travel of the thermal trip adjuster to between only the first location and a third location which is intermediate the first location and the second location. Also provided is a stop apparatus adjuster for adjusting the position of the stop apparatus.

BRIEF DESCRIPTION OF THE DRAWINGS

The following detailed description of the preferred embodiment may be better understood and further uses thereof are readily apparent when taken in conjunction with the following figures in which.

DETAILED DESCRIPTION OF THE PREFERRED EMBODIMENT

Figure 1:
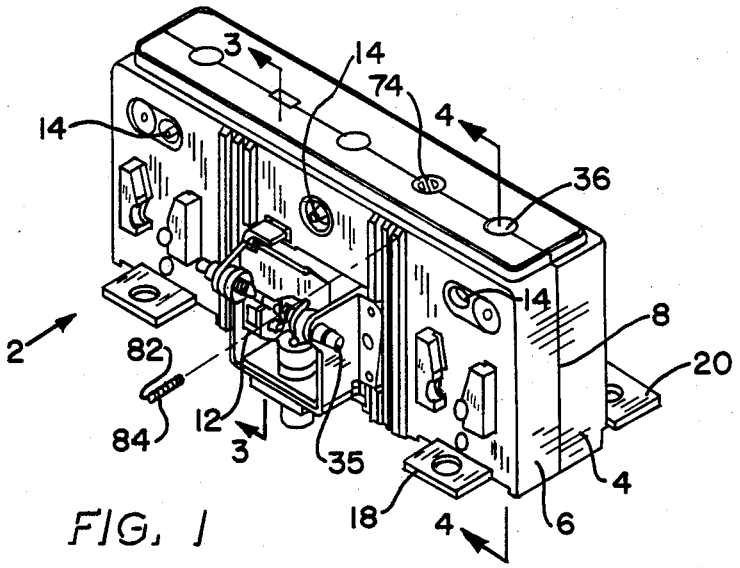
FIG. 1 is a perspective view of a thermal trip unit which utilizes the apparatus of the present invention.

FIGS. 1 through 7 show thermal trip unit 2. Trip unit 2 includes cover 4 and base 6 which meet at parting line 8 and form case 7. Cover 4 and base 6 are, preferably, molded plastic members which are adapted to support the various internal components of thermal trip unit 2. Thermal trip unit 2 includes sliding trigger 10 and rolling trigger 12 which are adapted to be connected to the operating mechanism of a typical electrical circuit breaker such as that disclosed in U.S. Pat. No. 4,255,732, the content of which is herein incorporated by reference.

The circuit breaker includes a tripping member (not shown) which is connected to the breaker trip mechanism and which is in contact with and applies a force against sliding trigger 10. Sliding trigger 10 rotates on pin 35. The force applied to sliding trigger 10 in the direction of arrow 17 causes cam surface 19 to apply a force on pin 21, which is mechanically connected to rolling trigger 12, in the direction of arrow 23. Rolling trigger 12 rotates on pin 25 and, therefore, the force applied to rolling trigger 12 causes projection 27, of rolling trigger 12, to apply a force on tab 29 of trip bar 32.

When trip bar 32 is rotated in the direction of arrow 13 by bimetal strip 46, projection 27 becomes disengaged from tab 29 causing rolling trigger 12 to rotate in the direction of arrow 15. That, in turn, allowing sliding trigger 10 to pivot about pin 35, in the direction of arrow 15 under the influence of the force applied by the circuit breaker tripping mechanism. That, in turn, causes the circuit breaker tripping member to move in unison with sliding trigger 10 to trip open the circuit breaker. Sliding trigger 10 and rolling trigger 12 are reset under the influence of biasing spring 31.

Cover 4 is attached to base 6 through the use of fasteners 14. The depicted trip unit 2 is designed to operate a three-pole circuit breaker and, therefore, three independent overcurrent sensors are provided; one for each pole. Since identical overcurrent sensors are provided for each pole, only one will be described in detail.

Thermal trip unit 2 includes bimetal/heater 16 which includes terminals 18 and 20. Terminals 18 and 20 are connected in series with the electrical circuit which is being protected by the associated electrical circuit breaker to which trip unit 2 is connected. Bimetal/-heater 16 forms part of electromagnet 22 which provides one of the two devices for tripping the associated circuit breaker during prescribed overcurrent conditions.

Figure 4:
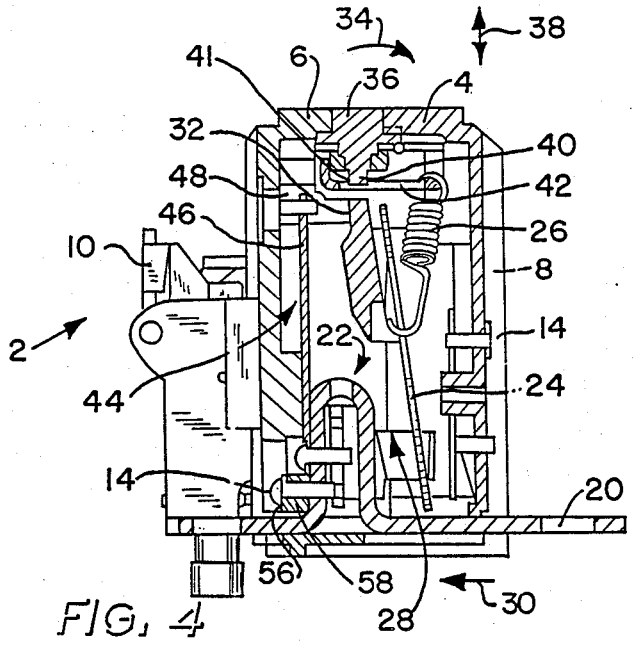
FIG. 4 is a side elevational sectional view of the apparatus of FIG. 1 taken along line 4—4.

Electromagnet 22 includes armature 24 which is held in the position shown in FIG. 4 by spring 26. If electrical current which is of a magnitude greater than approximately 500 percent of the rating of the associated circuit breaker flows between terminals 18 and 20, then magnetic flux is developed within area 28 which moves armature 24 in the direction of arrow 30. Armature 24 comes in contact with and rotates trip bar 32 in the direction of arc 34 thereby tripping the circuit breaker as described above.

The exact magnitude of current which will be sufficient to cause electromagnet 22 to trip the associated circuit breaker may be adjusted by rotating control 36. Rotation of control 36 moves lever 42 along line 38 thereby varying the biasing force of spring 26. That, in turn, varies the amount of force which must be applied by the magnetic flux on armature 24 to rotate trip bar 32.

The second device which is provided to trip the associated circuit breaker during prescribed overcurrent conditions, is bimetal trip unit 44. Bimetal trip unit 44 includes bimetal/heater 16, bimetal strip 46 and calibration screw 48.

Figure 2:
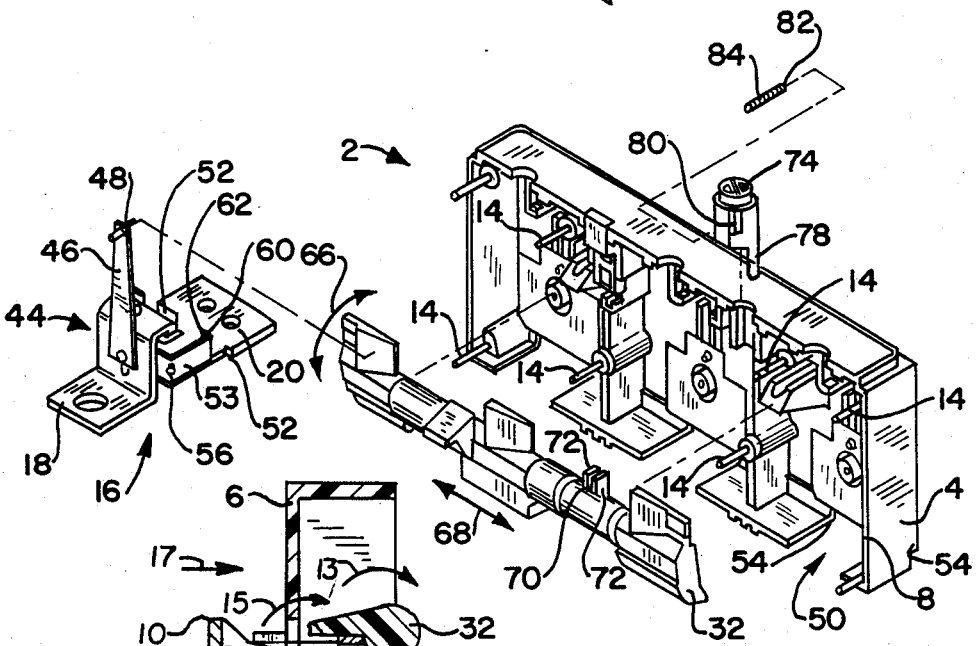
FIG. 2 is an exploded perspective view of the interior of the apparatus of FIG. 1.
Figure 3:
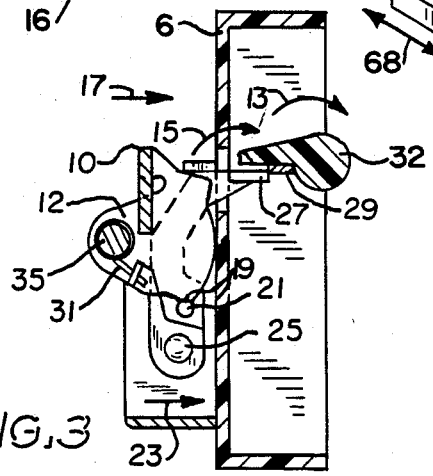
FIG. 3 is a side elevational sectional of the apparatus of FIG. 1 taken along line 3—3.

When no electrical current is flowing between terminals 18 and 20, bimetal strip 46 assumes the generally planar configuration as shown in FIGS. 2 and 4. Bimetal/heater unit 16 is positioned within opening 50 which is defined by cover 4 Shoulder 52, of terminal 20, engages surface 54 of cover 4. Base 6 engages surface 56 of heater 16 to secure bimetal/heater 16 within the interior of trip unit 2. Bracket 53 is secured to terminal 20 by a pair of flanges 60 (one shown) which are positioned within corresponding slots 62 (one shown). Bracket 53 secures armature 24 in position.

Figure 5:
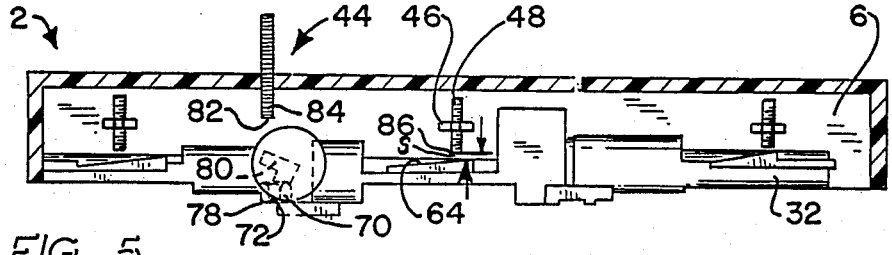
FIG. 5 is a front sectional elevational view of the apparatus of FIG. 1 in which the circuit breaker is adjusted to its minimum rating.
Figure 6:
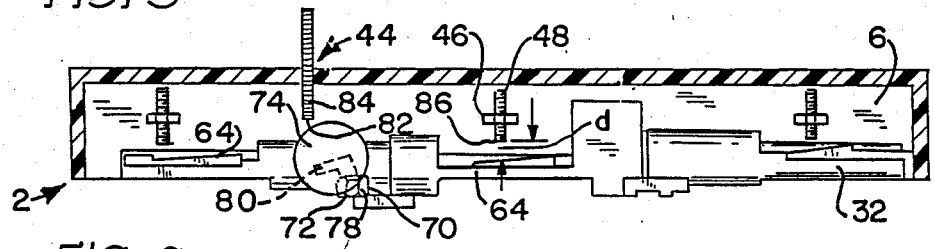
FIG. 6 is a front elevational sectional view of the apparatus of FIG. 1 in which the circuit breaker is adjusted to its maximum rating.
Figure 7:
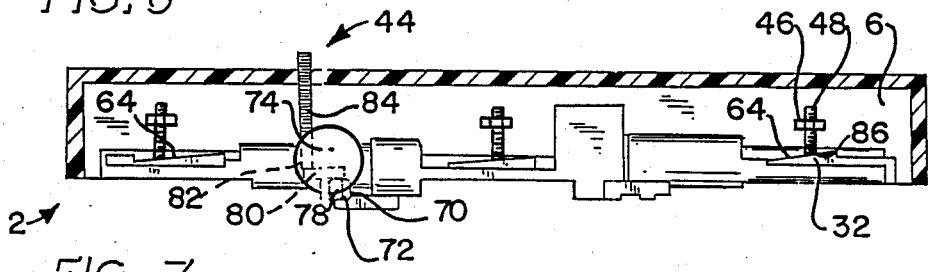
FIG. 7 is a front sectional elevational view of the apparatus of FIG. 1 in which the circuit breaker is adjusted to a rating intermediate the maximum rating and the minimum rating.

Calibration screw 48 is positioned in spaced relationship with ramp 64, as shown in FIGS. 5 through 7. Trip bar 32 is positioned within trip unit 2 so that it may both rotate about arc 66 and linearly slide along its longitudinal axis in the direction of arrow 68.

Trip bar 32 includes slot 70 which is defined by sidewalls 72. Thermal adjustment knob 74 includes trip bar slider 78 which is received within slot 70 of trip bar 32. Thermal adjustment knob 74 also includes stop surface 80 which may be rotated in and out of contact of end 82 of stop screw 84. Stop screw 84 and stop surface 80 form an important part of the present invention.

Initially, thermal adjustment knob 74 is rotated counterclockwise to the position shown in FIG. 6. Trip bar 32, thereby, slides linearly to the right to the high end. Adjustment knob 74 comes in contact with a portion of case 7 thereby preventing further rotation of knob 74 and preventing further linear movement of trip bar 32. When trip bar 32 is positioned as shown in FIG. 6, bimetal strip 46 is positioned its farthest possible distance from ramp 64. Calibration screw 48 is then adjusted so that the distance, d, between end 86 and ramp 64 corresponds to the distance that bimetal strip 46 must bend to contact ramp 64, and rotate trip bar 32, to trip the circuit breaker in sufficient time to protect the circuit when current in excess of the maximum rating of the circuit breaker is flowing.

The remaining calibration screws for the other poles are similarly adjusted. With stop screw 84 positioned, as shown in FIG. 5, thermal adjustment knob 74 may be rotated clockwise, thereby shifting trip bar 32 to the left to the low end. If trip bar 32 were carefully engineered and constructed, it may be possible that the distance, s, would be equal to the amount of bending required for bimetal strip 46 to rotate trip bar 36 when more than 80 percent of the maximum rated current is flowing through the electrical circuit. However, this is not practical and may be impossible if trip bar 32 is to be used in various trip units with different ratings for the same size of circuit breakers. The present invention overcomes this limitation.

After the trip unit 2 is calibrated to the maximum rating of the breaker, as described above, knob 74 is rotated and stop screw 84 is adjusted so that the distance between the end 86 of calibration screw 48 and ramp 64 corresponds to the distance that bimetal strip 46 must bend to contact ramp 64 and rotate trip bar 32, a sufficient distance to trip the circuit breaker in sufficient time to protect the circuit if more than 80 percent of maximum rated current is flowing through the circuit as shown in FIG. 7.

Stop surface 80, shown in detail in FIG. 2, defines one surface of a projecting member on knob 74. When stop screw 84 is rotated so that end 82 contacts surface 80, no further clockwise rotation of knob 74 is possible and the rating of the circuit breaker cannot be further reduced. However, knob 74 may still be rotated fully counterclockwise thereby raising the rating of the circuit breaker to its maximum value. Thereafter, it is easy to quickly change the rating between 100 percent and 80 percent of the maximum rating through the rotation of knob 74.

Intermediate values between 80 percent and 100 percent of the rating of the breaker may be achieved by rotating knob 74 to a position intermediate the full clockwise and full counterclockwise positions. Stop screw 84, thus, allows the low end of the trip unit to be calibrated independently of the high end without remachining or remolding ramp 64 to a different angle.

For purposes of illustration only, the low end rating was described above to be 80 percent of the maximum rating. However, it may be appreciated that other values above 80 percent and below 80 percent may be achieved through proper adjustment of stop screw 84.

It may be appreciated, therefore, that the present invention provides a simple, but accurate, apparatus for calibrating a circuit breaker thermal trip unit so that the trip unit may be adjusted only between 100 percent and some percentage of the rating of the breaker which is less than 100 percent. The apparatus of the invention is particularly useful where it is desired to interchange the trip unit among several different models of circuit breakers since recalibration is both accurate and easy to obtain.

Whereas particular embodiments of the invention have been described for purposes of illustration, it will be evident to those skilled in the art that numerous variations of the details may be made without departing from the invention as defined in the appended claims.

What is claimed is:

1. A circuit breaker, comprising:

separable main contacts for opening to interrupt electrical current flowing through an interconnected load;

rotatable trip bar means rotatable about an axis and translatable along said axis, said trip bar means having a face portion capable of being abutted by another member for the purpose of causing rotation of said trip bar means;

operating means interconnected mechanically between said separable main contacts and said rotatable trip bar means for causing said separable main contacts to open in relationship to the rotation of said rotatable trip bar means;

trip means angularly movable relative to said face portion along a predetermined path of travel as a function of said electrical current to abut said face portion at a predetermined location along said path of travel to cause said trip bar means to rotate to cause said separable main contacts to open at a predetermined magnitude of said electrical current; and adjustment means cooperable with said trip bar means for adjustment of the translational disposition of said trip bar means relative to said trip means within a range of adjustment to cause said face portion to be abutted by said trip means at a different location along said path of travel of said trip means to cause said trip bar means to rotate to cause said separable main contacts to open at a different magnitude of said electrical current.

2. The combination as claimed in claim 1 wherein said different magnitude of said electrical current is less than said predetermined magnitude of said electrical current.

3. The combination as claimed in claim 1 wherein said adjustment of said adjustment means is mechanically fixed after completion of adjustment.

4. The combination as claimed in claim 3 wherein said adjustment is adjustably mechanically fixed.

5. The combination as claimed in claim 4 wherein said predetermined magnitude of current is 100% of rated current and said different magnitude of electrical current is 80% of rated current and said adjustment means is adjustable for those values and for any value therebetween.

6. The combination as claimed in claim 1 wherein said trip means is a thermal trip means.

7. The combination as claimed in claim 6 wherein said thermal trip means comprises a bimetallic member.

8. The combination as claimed in claim 1 wherein said face portion is generally flat.

9. The combination as claimed in claim 1 wherein said face portion is angularly offset from said axis and said trip means moves along said path of travel generally perpendicular to said axis.

10. A trip unit usable with a circuit breaker of the kind which has separable main contacts for opening to interrupt electrical current flowing through an interconnected load, and operating means interconnected mechanically to said separable main contacts for causing said separable main contacts to open comprising:

rotatable trip bar means rotatable about an axis and translatable along said axis, said trip bar means having a face portion capable of being abutted by another member for the purpose of causing rotation of said trip bar means;

trip means angularly movable relative to said face portion along a predetermined path of travel as a function of said electrical current to abut said face portion at a predetermined location along said path of travel to cause said trip bar means to rotate to activate said operating means to cause said separable main contacts to open at a predetermined magnitude of said electrical current; and adjustment means cooperable with said trip bar means for adjustment of the translational disposition of said trip bar means relative to said trip means within a range of adjustment to cause said face portion to be abutted by said trip means at a different location along said path of travel of said trip means to cause said trip bar means to rotate to cause said separable main contacts to open at a different magnitude of said electrical current.

11. The combination as claimed in claim 10 wherein said different magnitude of said electrical current is less than said predetermined magnitude of said electrical current.

12. The combination as claimed in claim 10 wherein said adjustment of said adjustment means is mechanically fixed after completion of said adjustment.

13. The combination as claimed in claim 12 wherein said adjustment is adjustably mechanically fixed.

14. The combination as claimed in claim 13 wherein said predetermined magnitude of current is 100% of rated current and said different magnitude of electrical current is 80% of rated current and said adjustment means is adjustable for those values and for any value therebetween.

15. The combination as claimed in claim 10 wherein said trip means is a thermal trip means.

16. The combination as claimed in claim 15 wherein said thermal trip means comprises a bimetallic member.

17. The combination as claimed in claim 10 wherein said face portion is generally flat.

18. The combination as claimed in claim 10 when said face portion is angularly offset from said axis and said trip means moves along said path of travel generally perpendicular to said axis.

* * * * *